US006820585B2

(12) United States Patent
Maeda et al.

(10) Patent No.: US 6,820,585 B2
(45) Date of Patent: Nov. 23, 2004

(54) LUBRICATING OIL GUIDE DEVICE FOR ENGINE

(75) Inventors: Takashi Maeda, Kyoto (JP); Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/650,922

(22) Filed: Aug. 29, 2003

(65) Prior Publication Data

US 2004/0040532 A1 Mar. 4, 2004

(30) Foreign Application Priority Data

Aug. 29, 2002 (JP) ..... 2002-250420

(51) Int. Cl.[7] ..... F02B 33/28
(52) U.S. Cl. ..... 123/196 R
(58) Field of Search ..... 123/196 R, 196 CP, 123/195 R

(56) References Cited

U.S. PATENT DOCUMENTS 4,909,203 A * 3/1990 Fukuo ..... 123/196 R
5,467,843 A * 11/1995 Esch et al. ..... 184/6.5
5,850,814 A * 12/1998 Fenn et al. ..... 123/195 R
5,857,441 A * 1/1999 Yonezawa et al. ..... 123/196 R
6,250,274 B1 * 6/2001 Deane ..... 123/196 R
6,571,763 B1 * 6/2003 Bakker ..... 123/195 R
6,640,767 B2 * 11/2003 Kato et al. ..... 123/195 C
6,647,944 B2 * 11/2003 Kamiya ..... 123/195 R
6,666,183 B2 * 12/2003 Abe et al. ..... 123/195 R

FOREIGN PATENT DOCUMENTS

JP 2551974 Y2 7/1997

* cited by examiner

*Primary Examiner*—Henry C. Yuen
*Assistant Examiner*—Jason Benton
(74) *Attorney, Agent, or Firm*—Birch, Stewart, Kolasch & Birch, LLP

(57) ABSTRACT

Bearings and oil flow holes are formed on walls between cylinders of a cylinder block. Journals of a crank shaft are supported rotatably by the bearings and a bearing cap. The bearing cap has pairs of arms and a pair of beams which link the arms together. The arms face the under surfaces of the walls. The arms have vertical walls formed thereon. These vertical walls are formed on both sides of area right under the outlet of the oil flow hole along the top surface of the arm. An oil flowing through the outlet of the oil flow hole flows down along the top surface of the arm and the vertical walls and into an oil pan.

9 Claims, 4 Drawing Sheets

LUBRICATING OIL GUIDE DEVICE FOR ENGINE

CROSS-REFERENCE TO RELATED APPLICATIONS

This application is based upon and claims the benefit of priority from the prior Japanese Patent Application No. 2002-250420, filed Aug. 29, 2002, the entire contents of which are incorporated herein by reference.

BACKGROUND OF THE INVENTION

1. Field of the Invention

The present invention relates to an engine using a lubricating oil, particularly to a lubricating oil guide device therefor.

2. Description of the Related Art

In a reciprocal engine (hereinafter simply referred to as "engine") in which pistons make a reciprocating motion in cylinders, journals of a crank shaft are supported rotatably at the bottom of a cylinder block so as to convert the reciprocating motions of the pistons to rotational motions.

In such an engine in which the cylinders are aligned in series, walls which extend in a direction perpendicular to the direction in which the cylinders are aligned are formed in between adjacent cylinders at the bottom of the cylinder block so as to support the journals. On the under surfaces of the walls, semicircular bearings are formed. Under the bearings, bearing caps are attached. Between these bearings and bearing caps, the journals of the crank shaft are supported rotatably.

Such an engine has an oil pump to supply an oil to portions to be lubricated such as sliding portions and a hydraulic pressure device. By means of the oil pump, the oil is supplied to the portions to be lubricated and hydraulic pressure device. The oil used in the portions to be lubricated and the hydraulic pressure device is returned to an oil pan placed at the bottom of the cylinder block.

In general, a plurality of oil flow holes are formed in the cylinder block. The lower ends of the oil flow holes are opened to the under surfaces of the walls of the cylinder block, so that the oil which passes through the oil flow holes flows through the outlets of the oil flow holes into the oil pan.

Engines have been demanded to have improved rigidity without an increase in size. Consequently, as shown in FIG. 4, the rigidity of an engine is increased by linking both ends of bearing caps B together by means of beams D. The beams D extend in the direction in which cylinders C are aligned (axial direction of a crank shaft Al). A wall F is formed between adjacent cylinders C. On the under surface of the wall F, a bearing E for supporting the upper half of a journal A rotatably is formed. From both ends of each bearing cap B, arms G extend along the wall F. The arms G are linked together by the beams D. The beams D are disposed at the bottoms of the bearing caps B away from counter weights H.

As shown in FIG. 4, a journal A is formed between a pair of adjacent counter weights H. Thus, the counter weights H rotate inside the beams D in the vicinity of the arms G. Since the counter weights H rotate within narrow spaces formed by the arms G and the beams D, negative pressure occurs in the vicinity of the arms G periodically. Due to the negative pressure, an oil I flowing through the outlets of oil flow holes J is sucked into the inside of the beams D periodically and then scattered.

As the oil I is scattered, oil drops collide with the counter weights H, thereby causing an increase in frictions of the engine. Further, as the oil I is scattered, it is liable to deteriorate by making contact with air. Further, the scatter of the oil also causes air to be mixed into the oil.

BRIEF SUMMARY OF THE INVENTION

The present invention provides a lubricating oil guide device for an engine in which an oil flowing through oil flow holes of a cylinder block flows into an oil pan efficiently.

The present invention is a lubricating oil guide device for an engine comprising:

- a cylinder block having a plurality of cylinders, a crank shaft which is disposed under the cylinders, and
- a bearing cap module which supports the crank shaft in cooperation with the cylinder block, wherein the bearing cap module comprises:

- bearing caps which rotatably support the crank shaft in cooperation with the cylinder block,
- arms which extend from both sides of the bearing caps, and
- a pair of beams which extend in the axial direction of the crank shaft and link the arms together,
- the cylinder block has oil flow holes which extend in a vertical direction and have oil outlets at the lower ends, and
- the arm has vertical walls which sandwich an area right under the outlet and are formed along the top surface of the arm.

According to this constitution, the oil flowing through the outlets of the oil flow holes falls onto the arms, and it is guided by the vertical walls, and flows into an oil pan in the vicinity of the beam. Thus, the influence of negative pressure caused by rotations of counter weights on the oil flowing down through the outlets is suppressed.

In one embodiment of the present invention, the vertical walls extend from the inside to the outside of the rotation path of the crank shaft as viewed from the axial direction of the crank shaft. According to this constitution, the oil flowing along the arms is guided by the vertical walls from the inside to the outside of the rotation path of the crank shaft.

In one embodiment of the present invention, the vertical walls extend to the beam. According to this constitution, the oil flowing along the arms is guided to the beam by the vertical walls.

In one embodiment of the present invention, the vertical walls extend continuously from the top to bottom of the side face of the beam. According to this constitution, the oil flowing along the arms is guided to the bottom of the beam without scattering at the beam.

In one embodiment of the present invention, the arm has one end which continues to the corresponding bearing cap and the other end which is apart from the bearing cap and slopes downward from one end toward the other end, and the top portions of the vertical walls are situated at a position close to the under surface of the wall of the cylinder block where the outlet of the oil flow hole is formed so as to eliminate the space between the under surface of the wall and the arm situated right under the under surface.

In one embodiment of the present invention, the top portions of the vertical walls extend toward the under surface of the wall of the cylinder block where the outlet of the oil flow hole is formed. According to this constitution, the space between the under surface of the wall of the cylinder block and the arm is blocked, so that the scatter of the oil at the outlet of the oil flow hole is restrained.

In one embodiment of the present invention, the vertical walls are formed on only one of the pair of arms formed on each bearing cap. According to this constitution, when a blowby gas flow hole is formed above the other arm, the vertical walls do not interfere with flow of gas.

In one embodiment of the present invention, an oil pan for covering the bearing cap module is attached to the bottom of the cylinder block, and a baffle plate to be placed in the oil pan is attached to the bottom of the bearing cap module. According to this constitution, the scatter of the oil in the oil pan can be restrained by the baffle plate.

In one embodiment of the present invention, the baffle plate has through holes for guiding the oil which flows down along the top surfaces of the arms into the oil pan, in the vicinity of the lower ends of the arms. According to this constitution, the oil flowing along the top surfaces of the arms can be caused to flow into the oil pan from the vertical walls via the through holes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
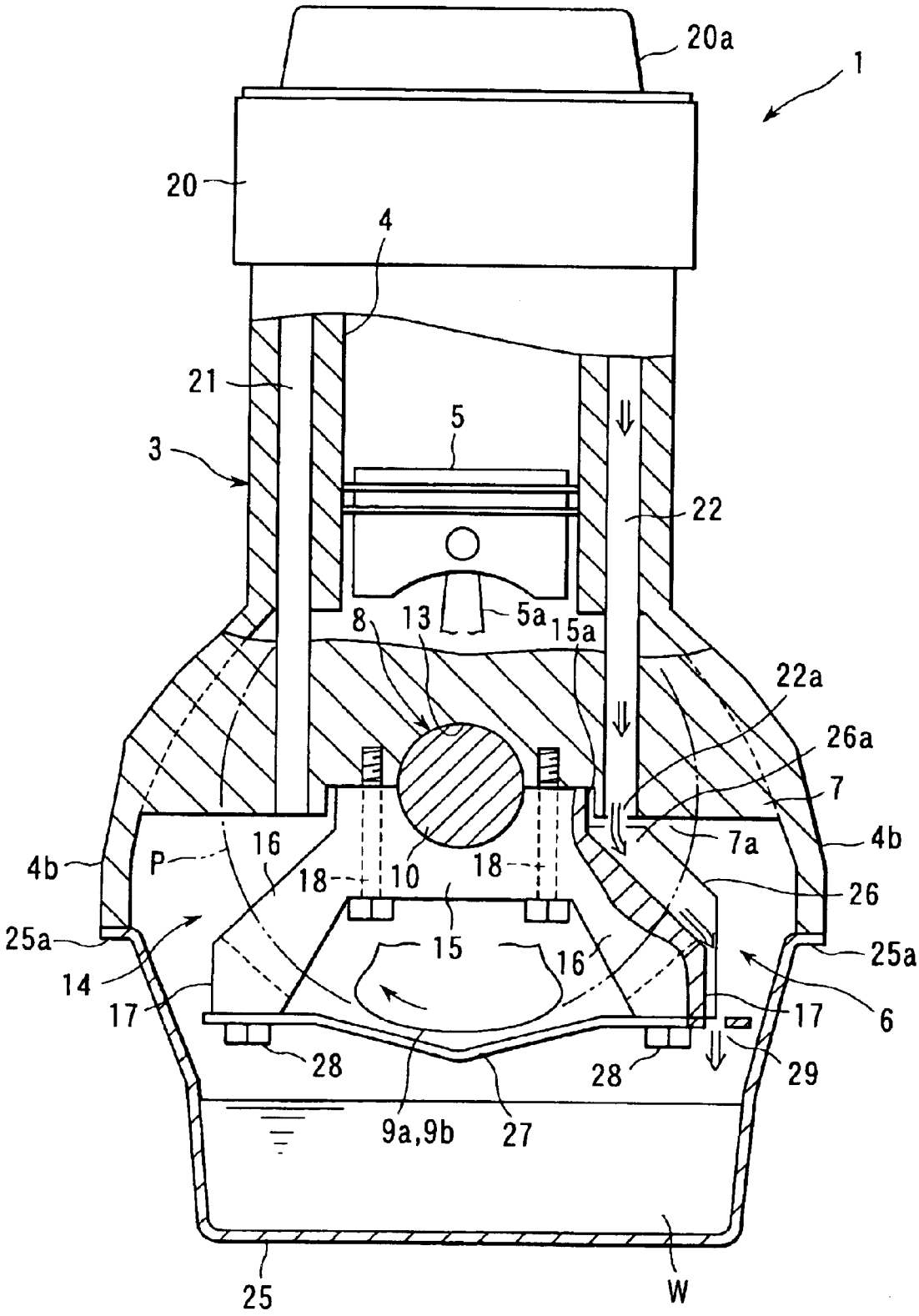
FIG. 1 is a front cross-sectional view of a portion of an engine incorporating a lubricating oil guide device of an embodiment of the present invention.
Figure 2:
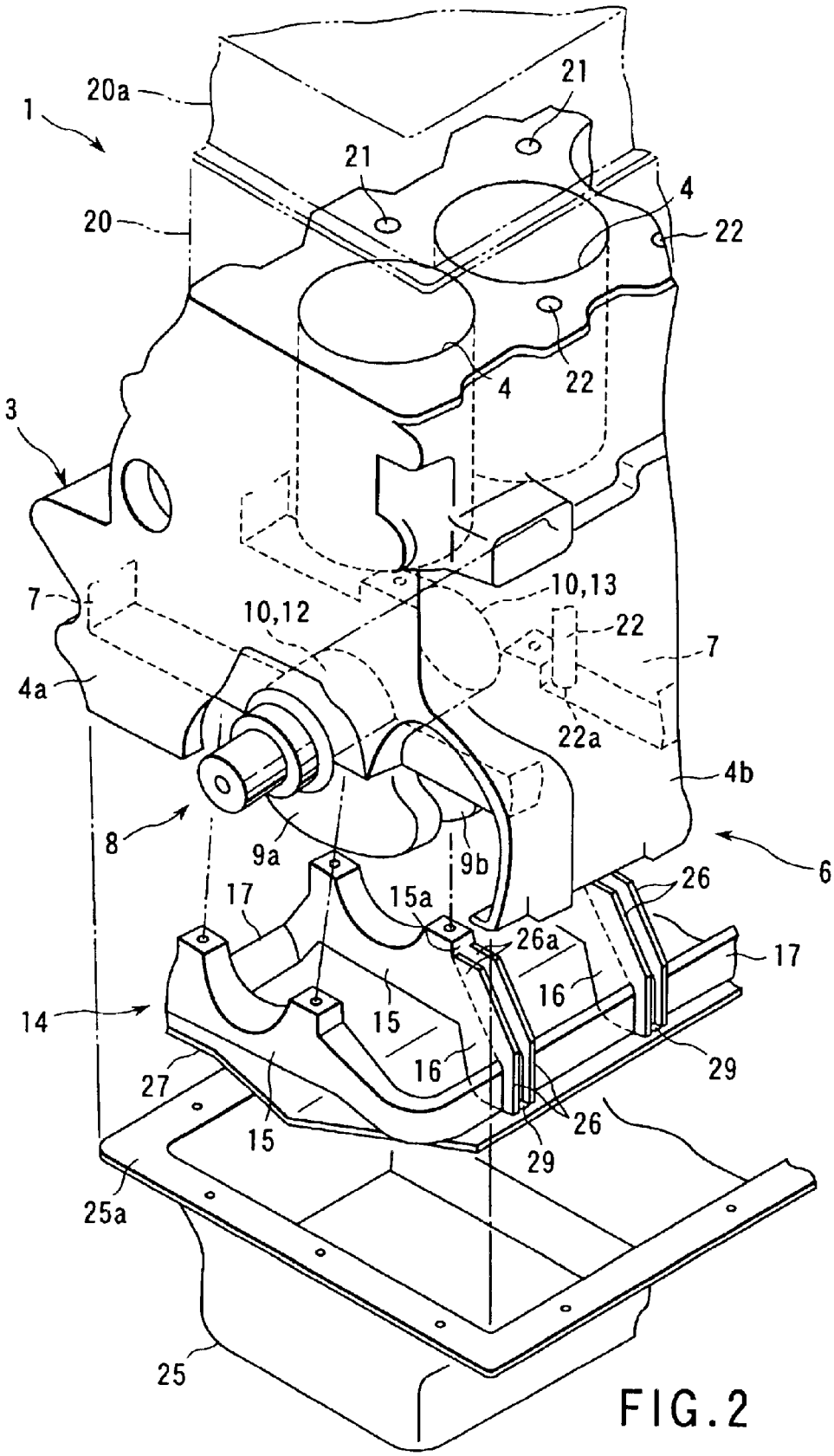
FIG. 2 is an oblique perspective view of a portion of the engine shown in FIG. 1 in a disassembled state.

Hereinafter, an embodiment of the present invention will be described with reference to FIGS. 1 to 3. FIG. 1 shows a reciprocal engine as an example of an internal combustion engine. FIG. 2 shows an engine body 1 of the engine.

The engine body 1 comprises a cylinder block 3, a cylinder head 20, and an oil pan 25. An example of the cylinder block 3 has such a shape that it is narrow in a width (left-right) direction and is larger in a front-back direction than in the width direction. The cylinder head 20 is mounted on the top of the cylinder block 3. The oil pan 25 is placed at the bottom of the cylinder block 3.

Inside the cylinder block 3, a plurality of hollow cylinders 4 are formed. These cylinders 4 are aligned in series in the longitudinal direction of the engine body 1. Each cylinder 4 is formed In a vertical direction and penetrates the cylinder block 3. As shown in FIG. 1, a piston S is placed in each cylinder 4. Together with a con-rod 5*a*, the piston 5 makes a reciprocating motion in an axial direction of the cylinder 4.

At the front and rear ends of the cylinder block 3, an end plate 4*a* is formed. The lower ends of these end plates 4 extend to below the cylinder block 3. on the left and right sides of the cylinder block 3, a skirt 4*b* which extends downward is formed. On the underside or the cylinder block 3, a crank case 6 which is surrounded by the end plates 4*a* and the skirts 4*b* is defined.

In the lower portion of the cylinder block 3, a wall 7 is formed between adjacent cylinders 4. All walls 7 project in a direction perpendicular to the direction in which the cylinders 4 are aligned. The under surfaces 7*a* of these walls 7 are located in the vicinity of the middle in a vertical direction of the crank case 6. In the crank case 6, a crank shaft 8 is placed rotatably.

On the crank shaft 8, a crank pin (not shown) and journals 10 are placed in series for each cylinder 4. In the vicinity of the journals 10 on the crank shaft 8, counter weights 9 are disposed. Each crank pin is situated right underneath the corresponding cylinder 4.

On the under surfaces of the end plates 4*a*, semicircular bearings 12 (shown in FIG. 2) are formed. On the under surfaces of the walls 7 as well, semicircular bearings 13 are formed. Of a pair of journals 10, the upper half of one of the journals 10 fits in the bearing 12 of the end plate 4*a*, and the upper half of the other journal 10 fits in the bearing 13 of the wall 7.

The lower half of each journal 10 is covered with a bearing cap module 14. As shown in FIG. 2, the bearing cap module 14 comprises bearing caps 15, arms 16, and a pair of beams 17. Each bearing cap 15 has a semicircular concave portion to cover the lower half of the journal 10 from below. From both sides of each bearing cap 15, a pair of arms 16 extend along the under surface 7*a* of the wall 7.

The beams 17 each extend in the direction in which the cylinders 4 are aligned (i.e., axial direction of the crank shaft 8). One of the beams 17 which is located on the right side in FIG. 1 links the tips of the arms 16 on the right side together, while the other beam 17 which is located on the left side in FIG. 1 links the tips of the arms 16 on the left side together.

Each arm 16 has one end which continues to the corresponding bearing cap 15 and the other end which is apart from the bearing cap 15 and slopes downward from one end toward the other end. Hence, as the upper surface of the arm 16 which faces the under surface 7*a* of the wall 7 goes away from the crank shaft 8, it also goes away from the under surface 7*a* of the wall 7. As shown in FIG. 1, each bearing cap 15 is fixed to the end plate 4*a* or wall 7 by means of bolt members 18.

As shown in FIG. 1, the pair of beams 17 are placed off the rotation paths P of the counter weights 9. To be more specific, these beams 17 are disposed on both sides under the rotation path P. By the bearing caps 15 with the beams 17, the journals 10 of the crank shaft 8 are supported rotatably, and the rigidity of the engine body 1 is increased.

In the cylinder head 20, a combustion chamber, a spark plug, an injector and a valve drive mechanism (which are not shown) are installed for each cylinder 4. The valve drive mechanism comprises an intake valve and an exhaust valve which are driven by the rotation of the crank shaft 8. By the igniting action of the spark plug, the inhaling action of the intake valve, the exhausting action of the exhaust valve and the injecting action of the injector, a given cycle (inhalation, compression, combustion, emission) is repeated in each cylinder 4.

The oil pan 25, as shown in FIGS. 1 and 2, is formed in the form of a box with its upper side opened. Around the rim of the opening of the oil pan 25, a flange 25*a* is formed. The flange 25*a* is fixed to the lower ends of the end plates 4*a* and skirts 4*b* which surround the crank case 6. The oil pan 25 is attached to the bottom of the cylinder block 3 in such a manner that it covers the lower opening of the crank case 6. In the oil pan 25, the bearing cap module 14 is placed.

In the oil pan 25, an oil W which serves as a lubricating oil is placed. The oil W is supplied to a portion to be lubricated by an oil pump (not shown) via an oil supply route (not shown) which is formed in the cylinder block 3 and the cylinder head 20. Examples of the portion to be lubricated include the bearings 12 and 13, the bearing cap 15, and the valve drive mechanism. The oil W is also supplied to a device (not shown) which requires hydraulic pressure.

As shown in FIGS. 1 and 2, on one side (left side in FIG. 1) of the cylinder block 3, a gas flow hole 21 is formed on the left side between the adjacent cylinders 4. These gas flow holes 21 extend linearly in a vertical direction. The upper ends of the gas flow holes 21 are opened to the top surface of the cylinder block 3. The lower ends of the gas flow holes 21 are opened to the bottom surface of the cylinder block 3, i.e., to the bottom surfaces of the walls 7 on the left side. From this opening, a blowby gas inside the crank case 6 flows into the gas flow hole 21.

The upper end of each gas flow hole 21 is connected to the inlet of an oil separator (not shown) via a gas channel (not shown) which is formed inside the cylinder head 20. The oil separator is mounted on the cam cover 20*a* of the cylinder head 20 and has a function of removing a liquid component such as the oil from the blowby gas.

On another side (right side in FIG. 1) of the cylinder block 3, an oil flow hole 22 is formed on the right side between the adjacent cylinders 4. Each oil flow hole 22 extends linearly in a vertical direction. The upper end of each oil flow hole 22 is opened to the top surface of the cylinder block 3. The upper end of the oil flow hole 22 is connected to the foregoing valve drive mechanism and hydraulic pressure device via an oil channel (not shown) which is formed inside the cylinder head 20. After used in these devices, the oil W flows into the oil flow hole 22 via the oil channel.

Each oil flow hole 22 is also communicated with portions to be lubricated such as the bearing 12 and the bearing cap 15 via an oil channel (not shown) which is formed in the cylinder block 3. The oil used in these portions to be lubricated also flows into the oil flow holes 22.

As shown in FIG. 1, the lower ends of the oil flow holes 22, i.e., oil outlets 22*a*, are opened to the under surface of the cylinder block 3. More specifically, the oil outlets 22*a* are opened to the under surfaces 7*a* of the walls 7 on the right side. The outlet 22*a* is opened in the vicinity of the bearing 13, and the oil flown through the outlet 22*a* flows down to the oil pan 25 via the arm 16.

In order to guide the oil W flown through the outlet 22*a* of the oil flow hole 22 to the oil pan 25, the bearing cap module 14 has a windshield structure using vertical walls 26 and a baffle plate 27. As shown in FIGS. 1 and 2, the vertical walls 26 are provided only to the arms 16 which face the outlets 22*a* of the oil flow holes 22, out of the pairs of left and right arms 16.

Hereinafter, the windshield structure of the bearing cap module 14 will be described with reference to FIG. 3. On the arm 16, a pair of front and rear vertical walls 26 are formed parallel to each other.

These vertical walls 26 are formed on both sides of the arm 16 such that it sandwiches an area right underneath the outlet 22*a* of the oil flow hole 22 and project upward. These vertical walls 26 extend diagonally from around the boundary between the side face 15*a* of the bearing cap 15 and one end of the arm 16 down to the other end of the arm 16 along the top surface of the arm 16 and reach the side face of the beam 17.

These vertical walls 26 are formed parallel to each other from the vicinity of the outlet 22*a* of the oil flow hole 22 toward the beam 17. Accordingly, the oil W flown through the outlet 22*a* and down to between the vertical walls 26 is guided to the beam 17 along the top surface of the arm 16.

The top portions 26*a* of the vertical walls 26 which are situated in the vicinity of the outlet 22*a* of the oil flow hole 22 are close to the under surface 7*a* of the wall 7. Desirably, the top portions 26*a* of the vertical walls 26 extend upward so as to eliminate the space S (shown in FIG. 3) between the top portions 26*a* of the vertical walls 26 and the under surface 7*a* of the wall 7.

These top portions 26*a* of the vertical walls 26 are situated on both front and rear sides of an area right under the outlet 22*a* of the oil flow hole 22. By these top portions 26*a* of the vertical walls 26, the space between the under surface 7*a* of the wall 7 and the top surface of the arm 16 is eliminated. The heights of the vertical walls 26 are such that the oil W which flows down on the top surface of the arm 16 is hardly influenced by the wind caused by the counter weights 9 which rotate in the vicinity of the arm 16.

The baffle plate 27 is disposed between the bearing cap module 14 and the oil pan 25. The baffle plate 27 is formed of a plate member which is big enough to block the major portion of the opening of the oil pan 25. As shown in FIG. 1, the baffle plate 27 is fixed to the undersides of the beams 17 by means of bolts 28. Accordingly, the baffle plate 27 is situated at the bottom of the bearing cap module 14.

The baffle plate 27 has through holes 29 formed thereon. These through holes 29 each are formed under the lower ends of the arms 16 where the vertical walls 26 are formed. The oil W which flows down along the top surface of the arm 16 flows into the oil pan 25 by passing through the through hole 29. By use of the windshield structure using the vertical walls 26 and the baffle plate 27, the oil W flown through the outlets 22*a* of the oil flow holes 22 is returned to the oil pan 25 without being influenced by the air flow caused by rotations of the counter weights 9.

Hereinafter, the effect of the engine incorporating the above lubricating oil guide device will be described. By the combustion cycle of the engine, the pistons 5 make a reciprocating motion in the cylinders 4, and the crank shaft 8 revolves. The oil W inside the oil pan 25 is supplied to various portions to be lubricated and the hydraulic pressure device in the engine by means of the oil pump.

After used in the portions to be lubricated and the hydraulic pressure device, the oil W flows into the oil flow holes 22. After flowing into the oil flow holes 22, the oil W flows through the outlets 22*a* formed on the under surfaces 7*a* of the walls 7 and falls down to the top surfaces of the arms 16.

Figure 3:
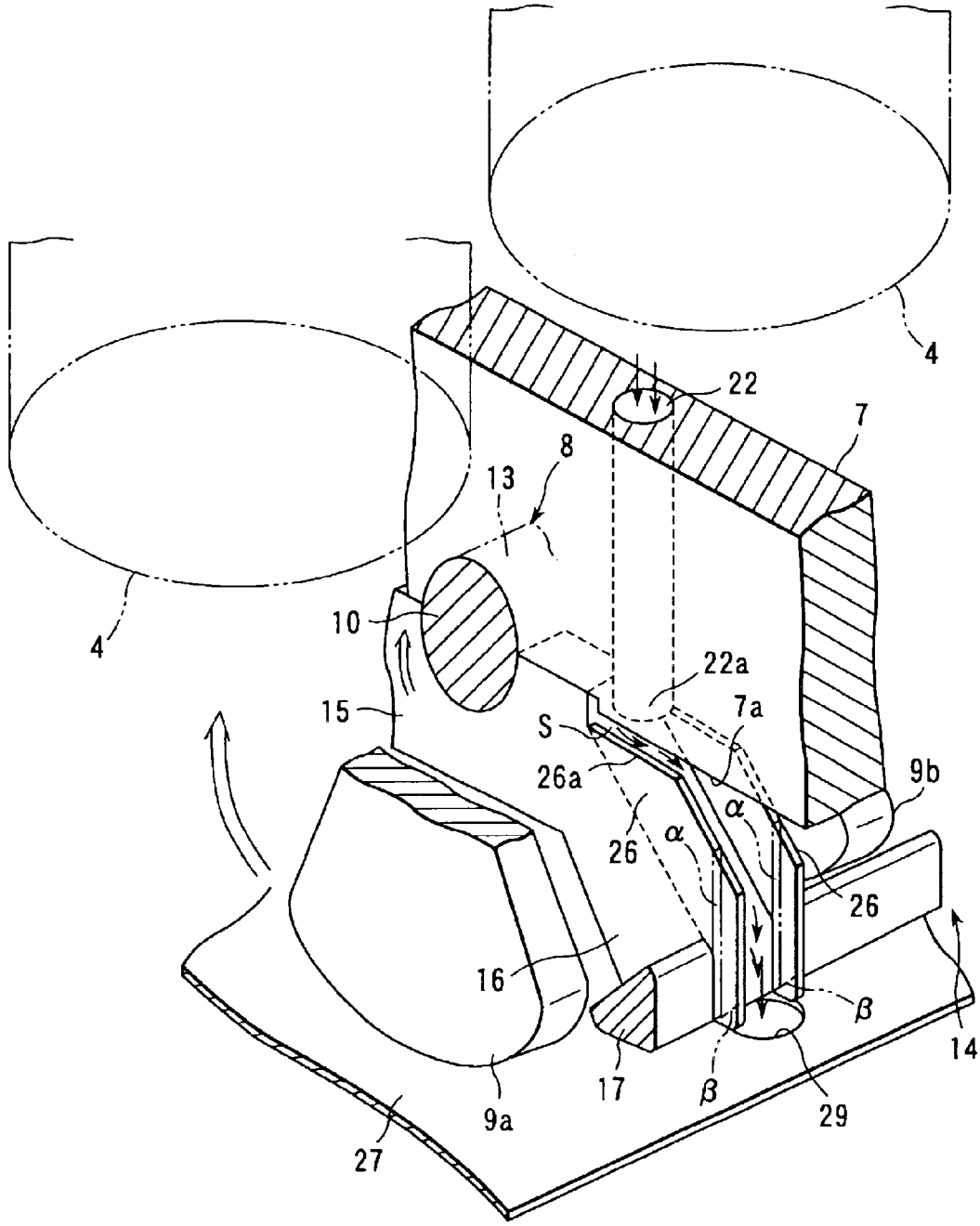
FIG. 3 is an enlarged oblique perspective view of a portion of the engine shown in FIG. 1.
Figure 4:
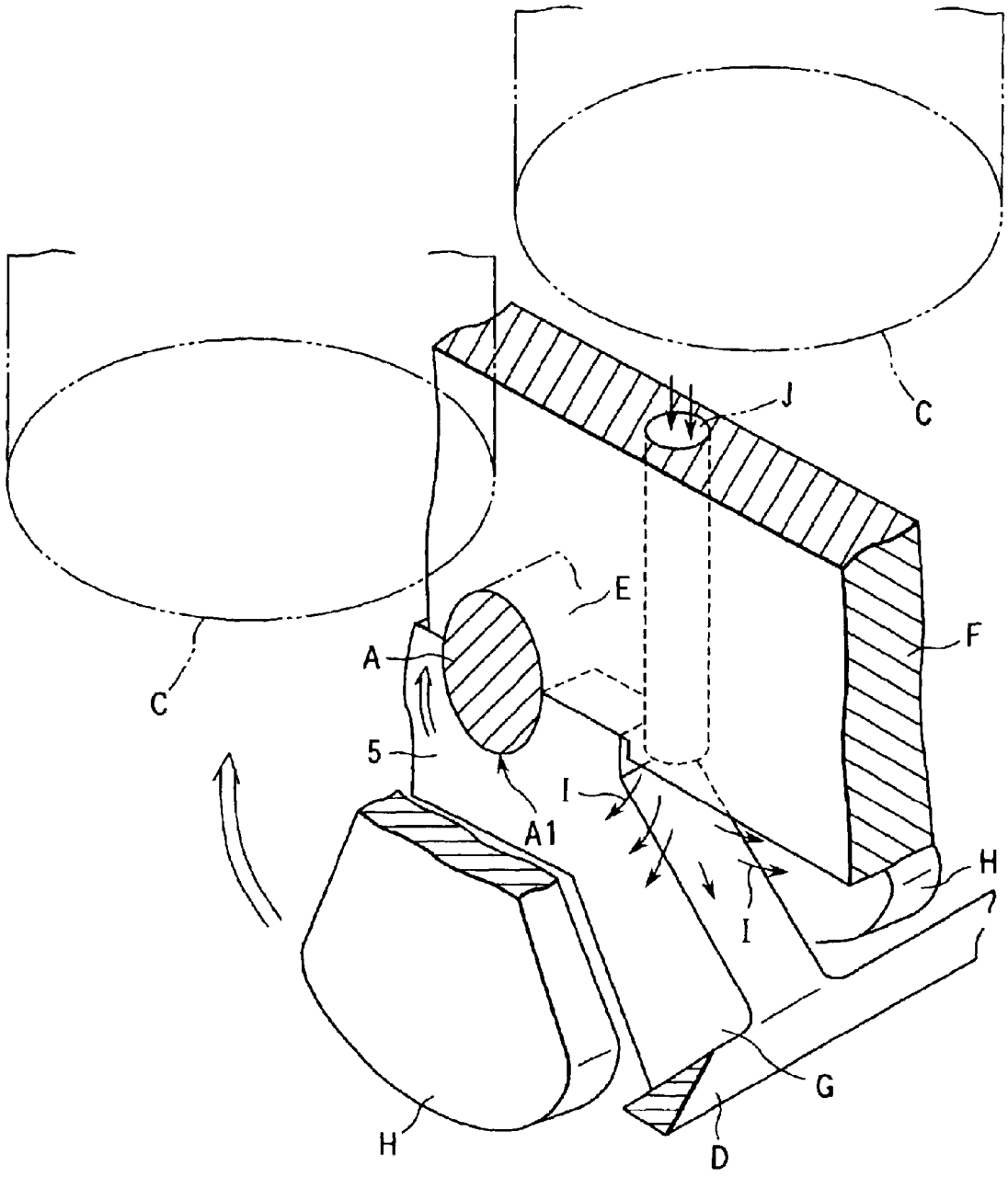
FIG.4 (PRIOR ART)
FIG. 4 is oblique perspective view of a portion of a conventional engine.

During operation of the engine, the counter weights 9 of the crank shaft 8 pass through narrow spaces defined by the arms 16 and the beams 17 as shown in FIG. 3. Thereby, negative pressure occurs in the vicinity of the arms 16 periodically.

The top portions 26*a* of a pair of vertical walls 26 are situated between the outlet 22*a* of the oil flow hole 22 and the arm 16 situated right under the outlet 22*a*. A pair of vertical walls 26 are present on both front and rear sides of the top surface of the arm 16 on which the oil W flows down. These vertical walls 26 are formed from the vicinity of the oil outlet 22*a* to the lower end of the arm 16.

Thus, the oil W flowing through the outlet 22*a* flows down to the top surface of the arm 16 while avoiding the influence of negative pressure occurring due to rotations of the counter weights 9. Then, the oil W flows down on the downwardly sloped top surface of the arm 16 along the vertical walls 26 and flows down to the lower end of the arm 16. The oil W flows down on the side face of the beam 17, passes through the through hole 29, and falls down to the inside of the oil pan 25.

Thereby, the oil W flowing through the oil flow hole 22 can return to the oil pan 25 while kept from scattering. Consequently, not only an increase in frictions of the engine due to the scatter of the oil W but also deterioration in the oil W can be restrained. Further, it can also be prevented that air bubbles are mixed into the oil W. In the present embodiment, in the vicinity of the outlet 22*a* of the oil flow hole 22, the top portions 26*a* of the vertical walls 26 extend from the top surface of the arm 16 toward the under surface 7*a* of the wall 7. Thereby, the scatter of the oil W can be prevented more effectively.

Further, the oil W flowing down on the top surface of the arm 16 is guided to the through hole 29 of the baffle plate 27 along the vertical walls 26 which extend to the side face of the beam 17, passes through the through hole 19, and flows down to the inside of the oil pan 25. Thus, the influence of negative pressure caused by the counter weights 9 can be restrained over the entire oil flow route spanning from the outlet 22*a* to the oil pan 25, so that the oil W can be recovered efficiently.

The vertical walls 26 formed on the arm 16 also serve as reinforcing ribs to increase the torsional rigidities of the bearing cap 15 and the bearing cap module 14. For this reason, the vertical walls 26 are also effective for increasing the rigidity of the engine body 1.

The present invention is not limited to the above embodiment and may be practiced with various modifications made without deviating from the effect of the present invention. For example, as shown by the chain double-dashed lines α in FIG. 3, the lower ends of the vertical walls 26 may be ended at the same position where the side face of the beam 17 is situated. Alternatively, as shown by the chain double-dashed lines β in FIG. 3, the lower ends of the vertical walls 26 may be formed diagonally upward from the under surface of the beam 17. Further, the entire top edges of the vertical walls 26 may be brought to a position close to the under surface 7*a* of the wall 7.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A lubricating oil guide device for an engine comprising:

a cylinder block having a plurality of cylinders, a crank shaft which is disposed under the cylinders, and a bearing cap module which supports the crank shaft in cooperation with the cylinder block, wherein the bearing cap module comprises:

bearing caps which rotatably support the crank shaft in cooperation with the cylinder block, arms which extend from both sides of the bearing caps, and a pair of beams which extend in the axial direction of the crank shaft and link the arms together, the cylinder block has oil flow holes which extend in a vertical direction and have oil outlets at the lower ends, and the arm has vertical walls which sandwich an area right under the outlet and are formed along the top surface of the arm.

2. The lubricating oil guide device of claim 1, wherein the vertical walls extend from the inside to the outside of the rotation path of the crank shaft as viewed from the axial direction of the crank shaft.

3. The lubricating oil guide device of claim 1, wherein the vertical walls extend to the beam.

4. The lubricating oil guide device of claim 1, wherein the vertical walls extend continuously from the top to bottom of the side face of the beam.

5. The lubricating oil guide device of claim 1, wherein the arm has one end which continues to the corresponding bearing cap and the other end which is apart from the bearing cap and slopes downward from one end toward the other end, and the top portions of the vertical walls are situated at a position close to the under surface of the wall of the cylinder block where the outlet of the oil flow hole is formed so as to eliminate the space between the under surface of the wall and the arm situated right under the under surface.

6. The lubricating oil guide device of claim 1, wherein the top portions of the vertical walls extend toward the under surface of the wall of the cylinder block where the outlet of the oil flow hole is formed.

7. The lubricating oil guide device of claim 1, wherein the vertical walls are formed on only one of the pair of arms formed on each bearing cap.

8. The lubricating oil guide device of claim 1, wherein an oil pan to cover the bearing cap module is attached to the bottom of the cylinder block, and a baffle plate to be placed in the oil pan is attached to the bottom of the bearing cap module.

9. The lubricating oil guide device of claim 8, wherein the baffle plate has through holes to guide an oil which flows down on the top surfaces of the arms into the oil pan, in the vicinity of the lower ends of the arms.

* * * * *